US007358933B2

(12) United States Patent
Cho

(10) Patent No.: US 7,358,933 B2
(45) Date of Patent: Apr. 15, 2008

(54) ELECTRON EMISSION DISPLAY AND DRIVING METHOD THEREOF

(75) Inventor: Duck-Gu Cho, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 551 days.

(21) Appl. No.: 11/046,619

(22) Filed: Jan. 27, 2005

(65) Prior Publication Data

US 2005/0190173 A1 Sep. 1, 2005

(30) Foreign Application Priority Data

Jan. 30, 2004 (KR) ..... 10-2004-0005980

(51) Int. Cl.
*G09G 3/20* (2006.01)
*G09G 3/22* (2006.01)

(52) U.S. Cl. ..... 345/74.1; 345/75.1; 345/75.2

(58) Field of Classification Search ..... 345/74.1, 345/74.2, 75.1, 211, 690
See application file for complete search history.

(56) References Cited

U.S. PATENT DOCUMENTS 6,060,840 A * 5/2000 Foo et al. ..... 315/169.1
7,009,344 B2 * 3/2006 Lee et al. ..... 315/169.3
7,190,334 B2 * 3/2007 Kawase et al. ..... 345/75.2

* cited by examiner

*Primary Examiner*—Duc Q Dinh
(74) *Attorney, Agent, or Firm*—Christie, Parker & Hales, LLP

(57) ABSTRACT

An electron emission display includes a display panel having a first substrate on which at least one first electrode is formed, a second substrate on which a second electrode and a third electrode on which an electron emission source is formed are formed. A fourth electrode is formed between the first and second substrates to focus towards a corresponding phosphor surface area on the at least one first electrode the electrons emitted by the electron emission source towards a corresponding phosphor surface area on the at least one first electrode, the second electrode being insulated from the third electrode and crossed therewith. A scan electrode driver applies scan pulses to the second electrode. A data electrode driver applies data pulses to the third electrode. A focusing electrode driver applies focusing voltages to the fourth electrode. The focusing electrode driver applies different voltages according to image displayed states on the display panel.

12 Claims, 2 Drawing Sheets

ELECTRON EMISSION DISPLAY AND DRIVING METHOD THEREOF

CROSS REFERENCE TO RELATED APPLICATION

This application claims priority to and the benefit of Korean Patent Application No. 10-2004-0005980 filed on Jan. 30, 2004 in the Korean Intellectual Property Office, the entire content of which is incorporated herein by reference.

BACKGROUND OF THE INVENTION

1. Field of the Invention

The present invention relates to a display device. More specifically, the present invention relates to an electron emission display and a driving method thereof.

2. Description of the Related Art

In general, a flat panel display (FPD) is a display device in which a wall is provided between two substrates to manufacture an airtight device, and appropriate elements are arranged in the airtight device to display desired images. The importance of the FPD has been emphasized following the development of multimedia technologies. In response to this trend, various flat type displays such as the liquid crystal display (LCD), the plasma display panel (PDP), and the field emission display (FED) have been put to practical use.

In particular, since an electron emission display uses phosphorous emission caused by electron beams in a like manner of the cathode ray tube (CRT), it has a high probability of realizing a flat-type display which maintains the excellent features of the CRT, provides no image distortion, and allows low power consumption. In particular, it satisfies view angle, high-rate response, high resolution, fineness, and slimness criteria, and accordingly, it has become the center of public attention as the next-generation display.

The above-described electron emission display uses a cold cathode rather than a hot cathode, which includes an FED, an surface conduction emitting display (SED), and an metal insulator metal (MIM) display.

FIG. 1 shows a cross-sectional view of an electron emission display. As shown, the electron emission display includes a rear substrate 11 and a front substrate 12. A cathode electrode 13 and a gate electrode 17 are formed with an insulation layer 16 therebetween on the rear substrate 11. An emitter 15 for emitting electrons according to the voltage applied to the cathode electrode 13 and the gate electrode 17 is formed on the cathode electrode 13.

The front substrate 12 is formed to face the rear substrate 11, and an anode electrode 14 for pulling the electrons output from the emitter 15 is formed on the front substrate 12. Also, a phosphor surface 19 of red, green, and blue phosphors for the pulled electrons to collide with and emit light is formed on the anode electrode 14.

A focusing electrode 18 is formed between the rear substrate 11 and the front substrate 12, and it focuses the electrons generated by the emitter 15 formed on the cathode electrode 13 so that the electrons may reach the desired phosphor surface 19. Further, a spacer 20 for dividing the anode electrode 14 and the focusing electrode 18 is used.

The above-configured electron emission display concentrates high fields on the emitter 15 to emit the electrons according to the quantum-mechanical tunnel effect, and the electrons emitted from the emitter 15 are accelerated by the voltage applied between the cathode electrode 13 (a scan electrode) and the gate electrode 17 (a data electrode) and collide with the phosphor surface 19 formed on the anode electrode 14, thereby emitting the light and displaying images.

The brightness of the images displayed when the emitted electrons collide with the phosphor surface 19 varies according to values of input digital video signals. In more detail, the values of the digital video signals have 8-bit RGB data. That is, the values of the digital video signals cover 0 ($00000000_{(2)}$) to 255 ($11111111_{(2)}$). 256 gray scales are represented by the 256 values, and the brightness of colors are represented by the digital values.

However, since the DC voltage is consecutively applied to the focusing electrode 18 in the conventional electron emission display, part of the electrons emitted from the emitter 15 are not provided to the anode electrode 14 but rather to the focusing electrode 18 or the spacer 20, and they charge the focusing electrode 18 or the spacer 20. As a result, the electrons charged in the focusing electrode 18 or the spacer 20 influence the emitted electrons around the spacer 20, and hence, the electron beams are bent, and the images around the spacer 20 and the focusing electrode 18 are distorted.

SUMMARY OF THE INVENTION

In accordance with the present invention to an electron emission display with less image distortion and a driving method for eliminating the electrons charged in a spacer or a focusing electrode, is provided.

In one aspect of the present invention, an electron emission display includes: a display panel having a first substrate on which at least one first electrode is formed, a second substrate on which a second electrode and a third electrode on which an electron emission source is formed are formed. A fourth electrode is formed between the first and second substrates and focuses electrons towards a corresponding phosphor surface area on the first electrode the electrons emitted by the electron emission source, the second electrode being insulated from the third electrode and crossed therewith. A scan electrode driver applies a scan pulse to the second electrode. A data electrode driver applies a data pulse to the third electrode. A focusing electrode driver applies a focusing voltage to the fourth electrode. The focusing electrode driver applies different voltages during the period in which the images are displayed on the display panel and the period in which the images are not displayed thereon.

A predetermined voltage is applied to the first electrode, and the electron emission source emits electrons towards a corresponding phosphor surface area on the first electrode corresponding to the voltage applied between the second and third electrodes to thus display images.

The focusing electrode driver maintains the voltage applied to the fourth electrode during the period in which the images are displayed on the display panel.

The focusing electrode driver applies a pulse with a voltage which is lower than the first voltage to the fourth electrode during the period in which no image is displayed on the display panel.

The focusing electrode driver applies to the fourth electrode during the period in which the images are displayed on the display panel a focusing voltage for allowing the electrons emitted by the electron emission source to reach a corresponding phosphor surface area on the first electrode. The focusing electrode driver applies a negative discharge voltage for discharging the charged charges to the fourth electrode during the period in which the images are not displayed.

In another aspect of the present invention, an electron emission display includes: a display panel having a first substrate on which at least one first electrode is formed, a second substrate on which a second electrode and a third electrode on which an electron emission source is formed are formed. A fourth electrode is formed between the first and second substrates and focuses towards a corresponding phosphor surface area on the at least one first electrode the electrons emitted by the electron emission source, the second electrode being insulated from the third electrode and crossed therewith. A scan electrode driver applies a scan pulse to the second electrode A data electrode driver applies a data pulse to the third electrode. A focusing electrode driver alternately applies a focusing voltage and a discharge voltage to the fourth electrode. A controller applies the scan pulse, the data pulse, the focusing voltage and the discharge voltage. The focusing electrode driver applies a discharge voltage to the fourth electrode during at least part of the period the scan pulse is applied to the scan electrode driver.

In still another aspect of the present invention, a method is provided for driving a display panel having a first substrate on which at least one first electrode is formed, a second substrate on which a second electrode and a third electrode on which an electron emission source is formed are formed, and a fourth electrode which is formed between the first and second substrates and focuses towards a corresponding phosphor surface area on the at least one first electrode the electrons emitted by the electron emission source, the second substrate being insulated from the second electrode and crossed therewith. The method includes: (a) applying a constant voltage to the first electrode; (b) applying a scan pulse to the second electrode; (c) applying a data pulse to the third electrode; (d) applying a focusing voltage to the fourth electrode, and (e) applying a negative discharge voltage to the fourth electrode during a period when images are not displayed.

DETAILED DESCRIPTION

Figure 2:
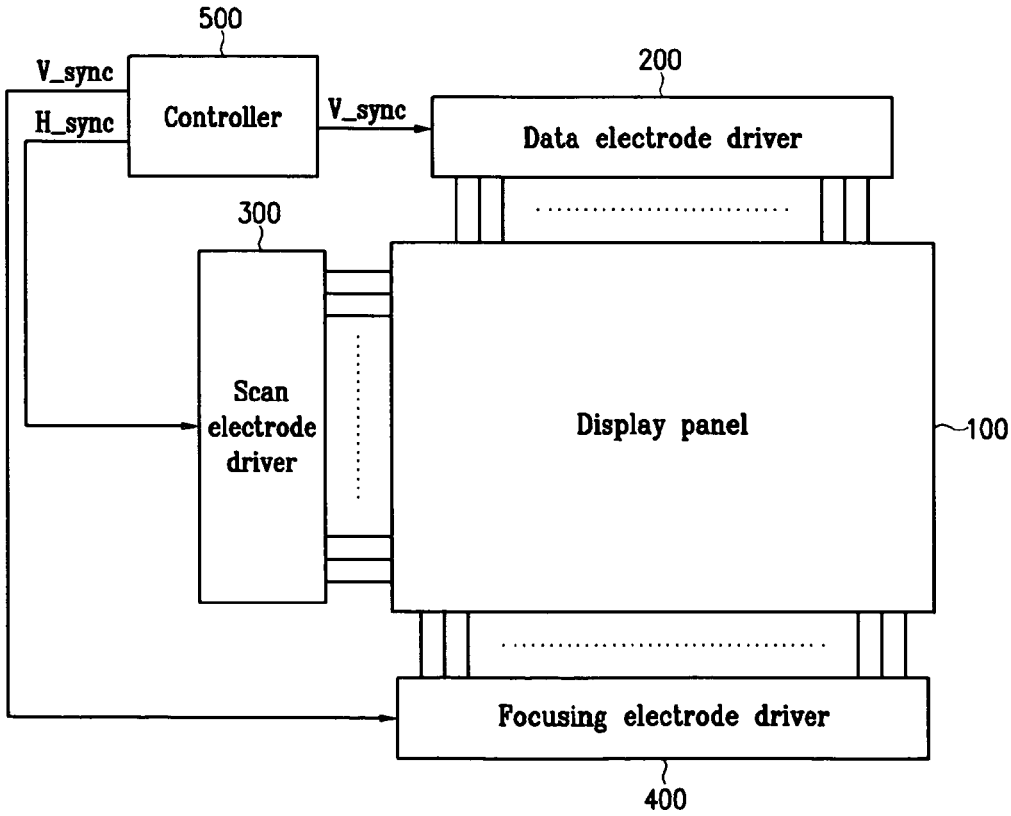
FIG. 2 shows a simplified block diagram configuration of an electron emission display according to an exemplary embodiment of the present invention.

Referring to FIG. 2, the electron emission display includes a display panel 100 for displaying images, a data electrode driver 200 for driving a data electrode, a scan electrode driver 300 for driving a scan electrode, a focusing electrode driver 400, and a controller 500.

The data electrode driver 200 supplies a data pulse to the data electrode according to data supplied states, and the scan electrode driver 300 sequentially supplies a scan pulse to the scan electrode.

The focusing electrode driver 400 controls the voltage applied to the focusing electrode. In more detail, the focusing electrode driver 400 applies a constant voltage during a period in which displaying is performed on the display panel 100, and applies a discharge pulse for each period in which no displaying is performed thereon, thereby discharging the electrons accumulated on a spacer or a focusing electrode.

The controller 500 outputs a synchronization signal for controlling the data electrode driver 200 and the scan electrode driver 300.

The data electrode driver 200 and the scan electrode driver 300 output a data pulse and a scan pulse respectively according to the synchronization signal output by the controller 500.

Also, the cathode electrode is used as a scan electrode, and the gate electrode is used as a data electrode according to the exemplary embodiment. In addition, the cathode electrode may be used as a data electrode, and the gate electrode is used as a scan electrode according to another exemplary embodiment.

Figure 1:
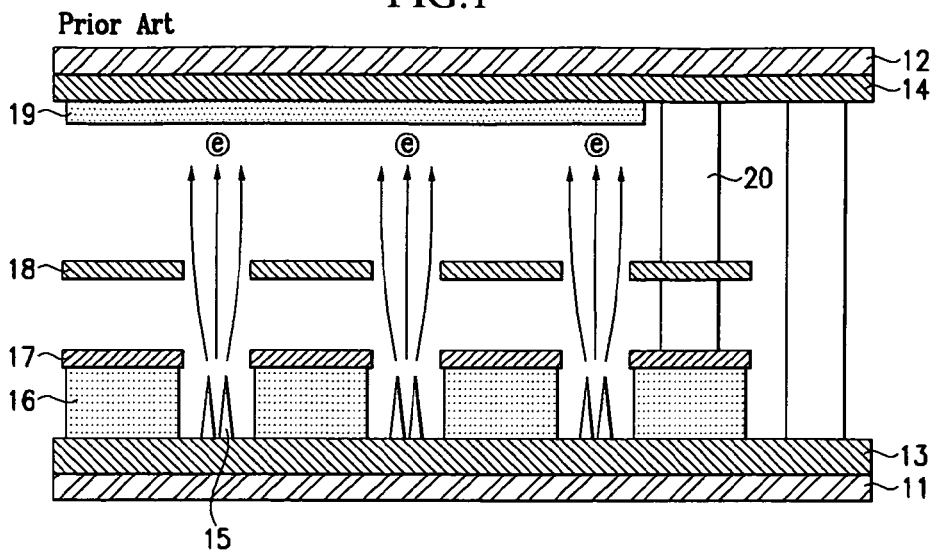
FIG. 1 shows a cross-sectional view of an electron emission display.

In an exemplary embodiment the display panel 100 shown in FIG. 2 is formed as shown in FIG. 1, but can be also formed in other structural formats which include a focusing electrode.

Figure 3:
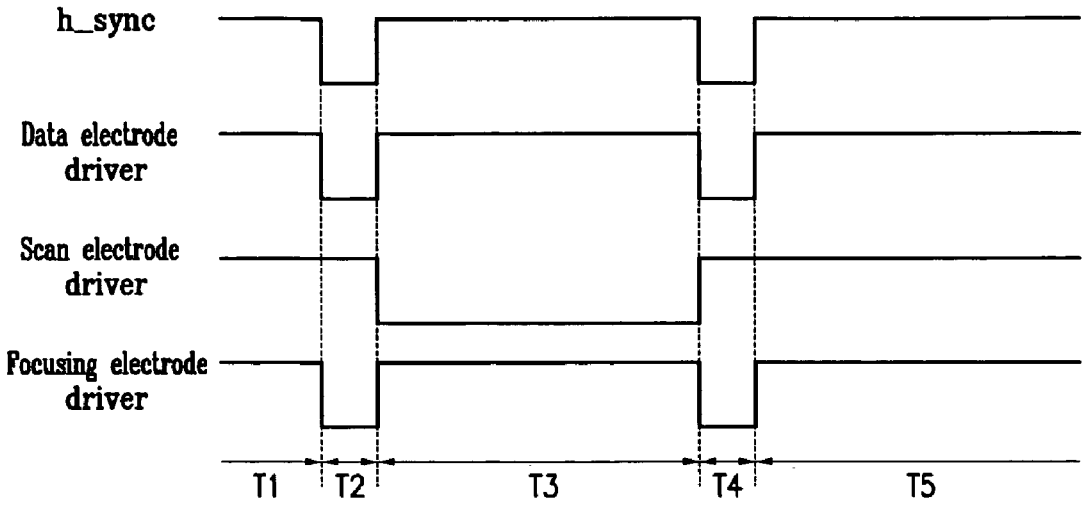
FIG. 3 shows a driving waveform of an electron emission display according to an exemplary embodiment of the present invention.

FIG. 3 shows a driving waveform of an electron emission display according to an exemplary embodiment of the present invention where h_sync is a synchronization signal of a single line output by the controller 500, and the scan electrode driver 300 applies the scan pulse to the scan electrode in synchronization with h_sync.

The focusing electrode driver 400 maintains a constant voltage during the periods T1, T3, and T5 in which the scan pulse is applied to the scan electrode of the display panel 100, and applies a negative discharge pulse which is lower than the constant voltage during the periods T2 and T4 in which no scan pulse is applied to the scan electrode, thereby discharging the electrons accumulated on the spacer or the focusing electrode.

In more detail, the focusing electrode driver 400 includes a switch for receiving the signal from the controller 500 and switching the same, and applies a discharge pulse within a desired period when the control signal applied to the switch is synchronized with h_sync.

In this instance, a transistor such as a MOSFET can be used for the switch as a voltage switching circuit, and for example, a switching circuit with an input voltage of 3.3V to 5V and an output voltage of several tens of volts can be used.

Figure 4:
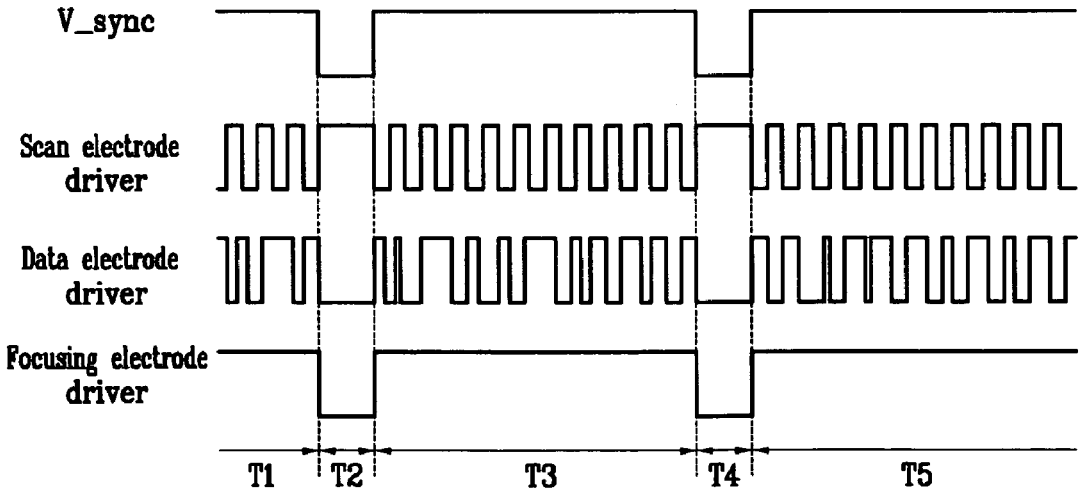
FIG. 4 shows a driving waveform of an electron emission display according to another exemplary embodiment of the present invention.

FIG. 4 shows a driving waveform of an electron emission display according to another exemplary embodiment of the present invention where v_sync is a synchronization signal output by the controller 500 per frame, and the data electrode driver 200 applies the data pulse to the data electrode in synchronization with v_sync.

The focusing electrode driver 400 maintains a constant voltage during the periods T1, T3, and T5 in which the data pulse is applied to the data electrode of the display panel 100, and applies a discharge pulse during the periods T2 and T4 in which no data pulse is applied to the data electrode, thereby discharging the electrons accumulated on the spacer or the focusing electrode.

In this case, the focusing electrode driver 400 includes a switch for receiving the signal from the controller 500 and switching the same, and applies a discharge pulse within a desired period when the control signal applied to the switch is synchronized with v_sync.

Accordingly, since the discharge pulse is applied for the respective blanking periods T2 and T4 of v_sync, the electrons accumulated on the spacer or the focusing electrode are discharged to thus suppress bending of the electron beams, and reduce the emission phenomenon of the electrons from the focusing electrode when the electrons charged in the focusing electrode exceed a predetermined level.

Further, the data pulse can be applied by a data enable signal (not illustrated) after the synchronization signal v_sync is applied. In this case, the focusing electrode driver 400 can apply the discharge pulse during the whole or part of the period until the data pulse is applied after the synchronization signal v_sync is applied. In a like manner, the focusing electrode driver 400 can apply the discharge pulse during the whole or part of the period until the scan pulse is applied after the synchronization signal h_sync is applied.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. An electron emission display comprising:

a display panel having:

a first substrate on which at least one first electrode is formed, a second substrate on which a second electrode and a third electrode, on which an electron emission source is formed, are formed, and a fourth electrode between the first substrate and the second substrate which focuses towards a corresponding phosphor surface area on the at least one first electrode electrons emitted by the electron emission source, the second electrode being insulated from and crossing the third electrode;

a scan electrode driver for applying a scan pulse to the second electrode;

a data electrode driver for applying a data pulse to the third electrode; and a focusing electrode driver for applying a focusing voltage to the fourth electrode, wherein the focusing electrode driver applies different voltages during a period in which images are displayed on the display panel and a period in which images are not displayed on the display panel.

2. The electron emission display of claim 1, wherein a voltage is applied to the first electrode, and the electron emission source emits electrons towards the corresponding phosphor surface area corresponding to a voltage applied between the second electrode and the third electrode to display images.

3. The electron emission display of claim 1, wherein the focusing electrode driver maintains the voltage applied to the fourth electrode during the period in which the images are displayed on the display panel.

4. The electron emission display of claim 1, wherein the focusing electrode driver applies a pulse with a voltage lower than a voltage applied to the fourth electrode during the period in which no image is displayed on the display panel.

5. The electron emission display of claim 1, wherein the focusing electrode driver applies a focusing voltage to the fourth electrode during the period in which the images are displayed on the display panel for allowing the electrons emitted by the electron emission source to reach a corresponding phosphor surface area, and the focusing electrode driver applies a negative discharge voltage for discharging charged charges to the fourth electrode during the period in which no image is displayed.

6. An electron emission display comprising:

a display panel having:

a first substrate on which at least one first electrode is formed, a second substrate on which a second electrode and a third electrode, on which an electron emission source is formed, are formed, and a fourth electrode between the first substrate and the second substrate which focuses towards a corresponding phosphor surface area on the at least one first electrode electrons emitted by the electron emission source, the second electrode being insulated from and crossing the third electrode;

a scan electrode driver for applying a scan pulse to the second electrode;

a data electrode driver for applying a data pulse to the third electrode;

a focusing electrode driver for alternately applying a focusing voltage and a discharge voltage to the fourth electrode; and a controller for applying the scan pulse, the data pulse, the focusing voltage and the discharge voltage, wherein the focusing electrode driver applies the discharge voltage to the fourth electrode during at least part of a period the scan pulse is applied to the scan electrode driver.

7. The electron emission display of claim 6, wherein the focusing electrode driver switches between the focusing voltage and the discharge voltage in response to a control signal synchronized with the first sync signal.

8. The electron emission display of claim 7, wherein the focusing voltage is a constant voltage for allowing the electrons emitted by the electron emission source to be focused on a corresponding phosphor surface of the first substrate.

9. The electron emission display of claim 6, wherein the focusing electrode driver applies the discharge voltage to the fourth electrode during at least part of the period the scan pulse is applied to the scan electrode driver.

10. A method for driving a display panel having a first substrate on which at least one first electrode is formed, a second substrate on which a second electrode and a third electrode, on which an electron emission source is formed, are formed, and a fourth electrode between the first substrate and the second substrate which focuses towards a corresponding phosphor surface area on the at least one first electrode electrons emitted by the electron emission source, the second electrode being insulated from and crossing the third electrode, the method comprising:

(a) applying a constant voltage to the first electrode;

(b) applying a scan pulse to the second electrode;

(c) applying a data pulse to the third electrode;

(d) applying a focusing voltage to the fourth electrode (e) applying a negative discharge voltage to the fourth electrode during a period when images are not displayed.

11. A method for driving an electron emission display having a display panel including a first substrate on which at least one anode electrode is formed, a second substrate on which a gate electrode and a cathode electrode, on which an electron emission source is formed, are formed, and a focusing electrode between the first substrate and the second substrate which focuses towards a corresponding phosphor surface area on the at least one anode electrode electrons emitted by the electron emission source, the gate electrode being insulated from and crossing the cathode electrode, the method comprising:

applying a scan pulse voltage to the cathode electrode and a data pulse voltage to the gate electrode to display images on a corresponding phosphor surface area; and applying different pulse voltages to the focusing electrode during a period in which an image is displayed on the display panel than during a period in which no image is displayed on the display panel.

12. The method of claim 11, further comprising applying to the focusing electrode during the period in which no image is displayed on the display panel a pulse with a voltage which is lower than a voltage applied to the focusing electrode during the period in which an image is displayed on the display panel.

* * * * *